US011669028B2

(12) United States Patent
Tanaka et al.

(10) Patent No.: US 11,669,028 B2
(45) Date of Patent: Jun. 6, 2023

(54) IMAGE FORMING APPARATUS HAVING CONTROL UNIT THAT CONTROLS DRIVE UNIT AND CONVEYANCE PORTION

(71) Applicant: Canon Kabushiki Kaisha, Tokyo (JP)

(72) Inventors: Masanobu Tanaka, Chiba (JP); Oki Kitagawa, Chiba (JP); Koichi Kakubari, Chiba (JP); Hiroto Ito, Toyko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/406,442

(22) Filed: Aug. 19, 2021

(65) Prior Publication Data

US 2022/0066362 A1 Mar. 3, 2022

(30) Foreign Application Priority Data

Sep. 3, 2020 (JP) ..... JP2020-147943

(51) Int. Cl.
*G03G 15/20* (2006.01)
*G03G 21/20* (2006.01)

(52) U.S. Cl.
CPC ..... *G03G 15/2028* (2013.01); *G03G 21/203* (2013.01)

(58) Field of Classification Search
CPC ..... G03G 21/203; G03G 15/2028
See application file for complete search history.

(56) References Cited

U.S. PATENT DOCUMENTS

2014/0147183 A1* 5/2014 Koshida ..... G03G 15/657 399/388

FOREIGN PATENT DOCUMENTS

| | | | | |
|---|---|---|---|---|
| JP | 10-221983 A | | 8/1998 | |
| JP | 3738946 B2 | * | 1/2006 | ..... B65H 29/70 |
| JP | 2012103405 A | * | 5/2012 | ..... G03G 15/2028 |
| JP | 2012-133084 A | | 7/2012 | |
| JP | 2015-004833 A | | 1/2015 | |
| JP | 2017-207648 A | | 11/2017 | |
| JP | 2018-043876 A | | 3/2018 | |

OTHER PUBLICATIONS

JP_3738946_B2_I MachineTranslation, Japan, 2006.*
JP_2012103405_A_I MachineTranslation, Asaoka, Japan, 2012.*

* cited by examiner

*Primary Examiner* — Victor Verbitsky
(74) *Attorney, Agent, or Firm* — Venable LLP

(57) ABSTRACT

According to one aspect of the present invention, an image forming apparatus includes a fixing unit comprising a fixing member configured to fix a toner image to a recording material, and a pressure member configured to form a first nip portion, a conveyance portion configured to form a second nip portion, and a control unit configured to execute, a conveyance mode of conveying the recording material so that the recording material is not looped between the first nip portion and the second nip portion prior to a predetermined timing during passing of the recording material of the first nip portion, and conveying the recording material so that the recording material is looped toward the pressure member from the predetermined timing until a trailing edge of the recording material has passed through the first nip portion.

17 Claims, 11 Drawing Sheets

IMAGE FORMING APPARATUS HAVING CONTROL UNIT THAT CONTROLS DRIVE UNIT AND CONVEYANCE PORTION

BACKGROUND OF THE INVENTION

Field of the Invention

The present invention relates to image forming apparatuses adopting an electrophotographic technique, such as a printer, a copying machine, a facsimile or a multifunction machine.

Description of the Related Art

An image forming apparatus adopting an electrophotographic technique is equipped with a fixing unit configured to fix a toner image to a recording material by applying heat and pressure to the recording material to which unfixed toner image has been formed. A fixing unit adopting a press-and-heat method equipped with an endless fixing film, a pressure roller abutted against an outer circumferential surface of the fixing film and being in pressure contact with the fixing film, and a heater for heating the fixing film is proposed (Japanese Patent Application Laid-Open Publication No. H10-221983). The fixing film is arranged on one side of the recording material to which an unfixed toner image is formed, and the pressure roller is arranged on an opposite side of the recording material. In the fixing unit, while the recording material to which an unfixed toner image has been formed is passed through a fixing nip portion formed between the fixing film and the pressure roller, heat and pressure is applied to the recording material, by which the toner image is fixed to the recording material. Further, a conveyance unit including a pair of conveyance rollers is arranged downstream of the fixing unit in a conveyance direction of the recording material. The pair of conveyance rollers is abutted against each other so as to form a conveyance nip portion for nipping and conveying the recording material having passed through the fixing unit.

There were cases where a trailing edge portion of the recording material was moved toward the fixing film and approached the fixing film while the recording material passed through the fixing unit. In that state, if the trailing edge portion of the recording material moves too close to the fixing film, due to the potential difference between the recording material and the fixing film, discharge, which is so-called spark discharge, is generated at a portion of the surface of the fixing film charged negatively for fixing the toner image and charge is turned to positive in the area where discharge was generated. Then, when a subsequent recording material being conveyed successively passes through the fixing nip portion, the toner on the recording material is transferred to the fixing film in the area where charge was turned to positive, and adheres to the fixing film, causing image defects.

Therefore, according to the apparatus disclosed in the above-mentioned Japanese Patent Application Laid-Open Publication No. H10-221983, a bias voltage is applied to the fixing film or the pressure roller to draw away the toner being adhered to the fixing film. Further, Japanese Patent Application Laid-Open Publication No. 2015-4833 discloses an apparatus in which air is blown toward a recording material passing through a fixing nip portion to suppress movement of the trailing edge portion of the recording material toward the fixing film.

However, according to the above-mentioned apparatuses, a power supply for applying the bias voltage to the fixing film or the pressure roller or an air blowout unit for blowing air toward the recording material must be provided additionally, so that the configuration of the apparatus becomes complex and the costs thereof are increased. Thus, there are demands for a configuration in which the occurrence of discharge between the trailing edge of the recording material and the fixing film can be reduced while suppressing the influence on the conveyance property of the recording material, without providing an additional power supply or air blowout unit.

SUMMARY OF THE INVENTION

According to one aspect of the present invention, an image forming apparatus includes an image forming unit configured to form a toner image on a recording material, a fixing unit comprising a fixing member configured to fix the toner image to the recording material, and a pressure member configured to abut against the fixing member and form a first nip portion configured to nip and convey the recording material, a first drive unit configured to rotate the fixing member, a conveyance portion arranged downstream of the first nip portion in a conveyance direction of the recording material and configured to form a second nip portion configured to nip and convey the recording material, the second nip portion being arranged at a position where a distance from the first nip portion is shorter than a length of the recording material being conveyed, a second drive unit configured to rotate the conveyance portion, and a control unit configured to execute, during an image forming job of forming an image on the recording material, a conveyance mode of conveying the recording material so that the recording material is not looped between the first nip portion and the second nip portion prior to a predetermined timing during passing of the recording material of the first nip portion, and conveying the recording material so that the recording material is looped toward the pressure member from the predetermined timing until a trailing edge of the recording material has passed through the first nip portion.

Further features of the present invention will become apparent from the following description of exemplary embodiments with reference to the attached drawings.

DESCRIPTION OF THE EMBODIMENTS

First Embodiment

Figure 1:
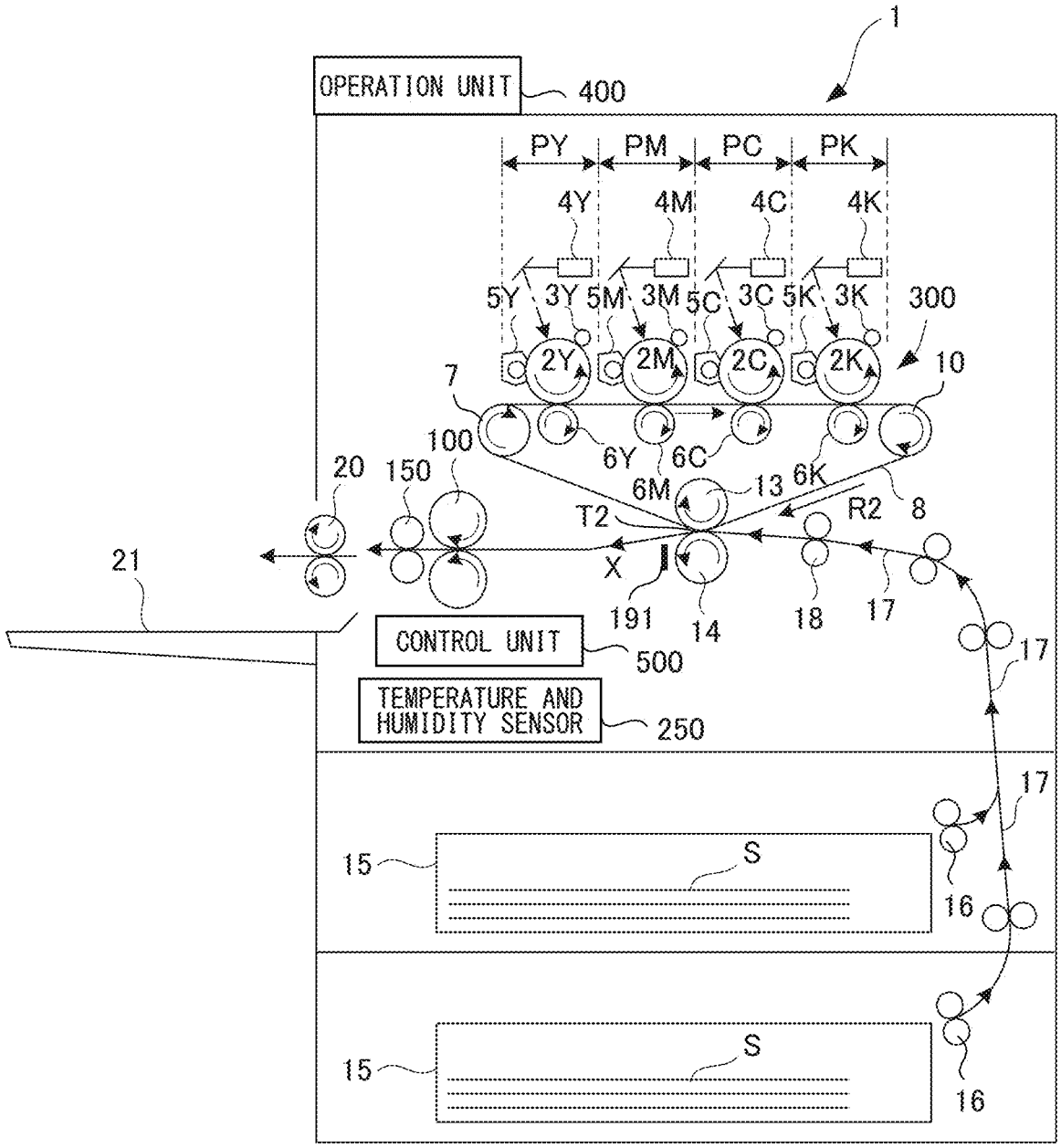
FIG. 1 is a schematic diagram illustrating a configuration of an image forming apparatus according to the present embodiment.

An embodiment will now be described. At first, a configuration of an image forming apparatus according to the present embodiment will be described with reference to FIG. 1. An image forming apparatus 1 illustrated in FIG. 1 is an intermediate transfer-type full-color printer including a plurality of image forming units PY, PM, PC and PK corresponding to yellow, magenta, cyan and black toner arranged along an intermediate transfer belt 8.

Image Forming Apparatus

Although not shown, the image forming apparatus 1 is an apparatus for forming an image on a recording material S according to an image information from a document reading apparatus connected to an apparatus body or an external device such as a personal computer connected to the apparatus body in a manner capable of communicating therewith. Various types of recording material such as normal paper, thick paper, rough paper, uneven paper, coated paper, plastic films, and cloth can be used as the recording material S. According to the present embodiment, an image forming unit 300 for forming a toner image on one side of the recording material S is configured by the image forming units PY to PK, primary transfer rollers 6Y to 6K, the intermediate transfer belt 8, a secondary transfer inner roller 13, and a secondary transfer outer roller 14.

As a conveyance process of the recording material S, for example, the recording material S is supported in a cassette 15 and fed one sheet at a time to a conveyance path 17 via a sheet feed roller 16 at a matched timing with the forming of image. Further, the recording material S supported on a manual feed tray not shown is fed one sheet at a time to the conveyance path 17. The recording material S is conveyed to a registration roller 18 arranged midway of the conveyance path 17, where the recording material S is subjected to skew feed correction and timing correction by the registration roller 18 before being sent to a secondary transfer portion T2. The secondary transfer portion 12 is a transfer nip portion that is formed by a secondary transfer inner roller 13 and a secondary transfer outer roller 14 which are arranged to oppose one another. At the secondary transfer portion T2, a secondary transfer voltage is applied from a high voltage power supply not shown to the secondary transfer outer roller 14 serving as a transfer member, by which the toner image is secondarily transferred from the intermediate transfer belt 8 to the recording material S.

An image forming process of an image being transmitted to the secondary transfer portion 12 at a similar timing as the conveyance process of the recording material S to the secondary transfer portion T2 mentioned above will be described. At first, the image forming units PY. PM, PC, and PK will be described. The image forming units PY, PM, PC, and PK are configured similarly except for the different toner colors of yellow, magenta, cyan, and black being used in developing units 5Y, 5M, 5C, and 5K. Hereafter, the yellow image forming unit PY is described as a representative example, and descriptions on other image forming units PM, PC and PK are omitted.

The image forming unit PY is mainly composed of a photosensitive drum 2Y, a charging unit 3Y, an exposing unit 4Y, and a developing unit 5Y. The photosensitive drum 2Y rotated by a motor not shown has its surface charged uniformly in advance by the charging unit 3Y, and thereafter, an electrostatic latent image is formed by the exposing unit 4Y driven based on image information signals. Next, the electrostatic latent image formed on the photosensitive drum 2Y is developed into a toner image using developer by the developing unit 5Y. Thereafter, a predetermined pressing force and a primary transfer bias are applied by the primary transfer roller 6Y that is arranged to oppose the image forming unit PY interposing the intermediate transfer belt 8, by which the toner image formed on the photosensitive drum 2Y is primarily transferred to the intermediate transfer belt 8. The intermediate transfer belt 8 serving as an image bearing member bears a toner image and rotates.

The intermediate transfer belt 8 is stretched across a stretching roller 7, the secondary transfer inner roller 13, and a tension roller 10, and is driven to move toward a direction of arrow R2. According to the present embodiment, the stretching roller 7 also serves as a driving roller for driving the intermediate transfer belt 8. The image forming processes of respective colors processed by the image forming units PY to PK mentioned above are performed at such a timing that the image is superposed on a toner image of different color upstream thereof in the direction of movement primarily transferred onto the intermediate transfer belt 8. As a result, a full-color toner image is finally formed on the intermediate transfer belt 8 and conveyed to the secondary transfer portion T2.

According to the conveyance process and the image forming process described above, the timings of the recording material S and the full-color toner image are matched at the secondary transfer portion T2, and the toner image is secondarily transferred from the intermediate transfer belt 8 to the recording material S. Thereafter, the recording material S to which toner image has been transferred is conveyed to a fixing unit 100, where heat and pressure is applied by the fixing unit 100 to fix the toner image onto the recording material S. The recording material S to which toner image has been fixed by the fixing unit 100 is conveyed by a conveyance unit 150 to a sheet discharge roller pair 20 and discharged by the sheet discharge roller pair 20 onto a sheet discharge tray 21 provided on an exterior of the apparatus. The recording materials S that have been discharged are supported on the sheet discharge tray 21.

Fixing Unit

Figure 2:
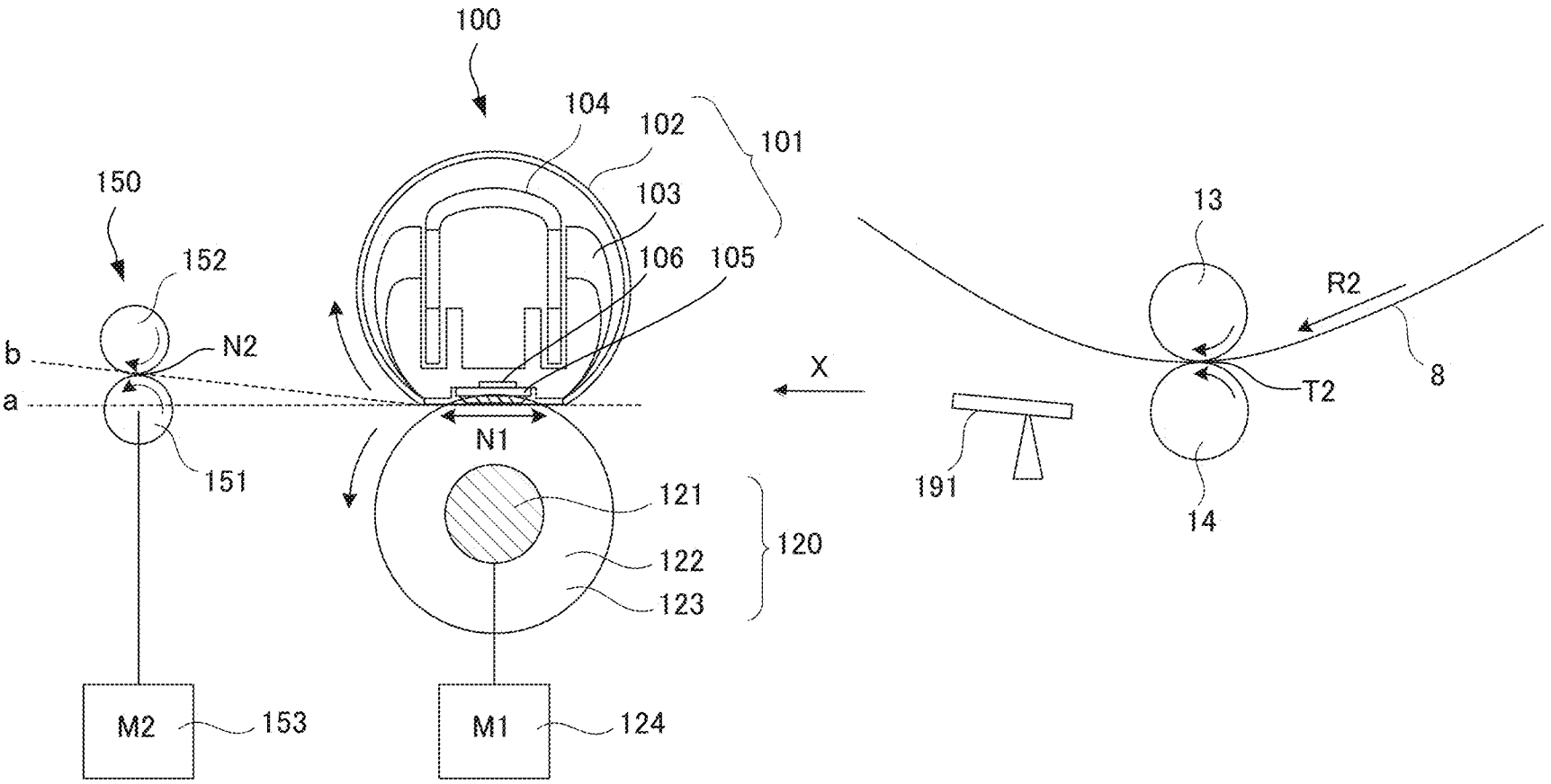
FIG. 2 is a schematic view illustrating a fixing unit and a conveyance unit according to a first embodiment.

Next, the fixing unit 100 will be described with reference to FIG. 2. As illustrated in FIG. 2, the fixing unit 100 includes a fixing film unit 101 and a pressure roller 120. According to the present embodiment, the fixing film unit 101 is provided movably toward the pressure roller 120. The fixing film unit 101 includes a fixing film 102, a heater holder 103, a stay 104, a heater 105, and a temperature sensor 106. In the following description, unless denoted otherwise, upstream refers to the upstream in a conveyance direction (arrow X direction) of the recording material S, and downstream refers to the downstream in the conveyance direction of the recording material S.

Fixing Film

The fixing film 102 serving as a fixing member is an endless belt member having flexibility. The fixing film 102 has an elastic layer formed on a base material and a release layer formed on the elastic layer. The base material is a metal film made of stainless steel formed into a tubular shape having a thickness of "30 to 35 μm", for example. The elastic layer is a silicon rubber layer having a thickness of "200 μm", for example, and the release layer is a perfluoro alkoxy alkane (PFA) resin tube having a thickness of "30 μm", for example. Grease is applied as a lubricant to an inner circumferential surface of the fixing film 102. This arrangement is adopted to enhance the slidability of the inner circumferential surface of the fixing film 102 and the heater holder 103 or the heater 105 described later abutting against the inner circumferential surface of the fixing film 102. Other than stainless steel, the base material of the fixing film 102 can be made of an alloy formed of metal materials such as nickel, copper, or aluminum, or a heat-resistant resin such as polyimide.

Stay

The stay 104 is formed of a sheet metal having a high stiffness and arranged in a nonrotatable manner on an inner side of the fixing film 102. The stay 104 is pressed toward the pressure roller 120 with a predetermined pressing force (such as 90 to 320 N) by a pressure mechanism not shown. Thereby, a fixing nip portion N1 is formed where the fixing film 102 and the pressure roller 120 are in pressure contact with one another to nip and convey the recording material S while applying heat and pressure thereto. According to the present embodiment, the fixing nip portion N1 serving as a first nip portion is formed so that a length thereof is "approximately 5.5 to 6.5 mm" in a conveyance direction (arrow X direction) of the recording material S.

Heater Holder

The heater holder 103 is formed, for example, of a resin member having a high resisting property and a high heat insulating property, and it is arranged in a nonrotatable manner on the inner side of the fixing film 102, similarly as the stay 104. The heater holder 103 supports the heater 105 and guides the fixing film 102. The heater holder 103 holds the heater 105 at a side opposite from the stay 104, that is, the fixing nip portion N1 side, such that the heater 105 abuts against the inner circumferential surface of the fixing film 102 to heat the fixing film 102. Thereby, while the recording material S passes through the fixing nip portion N1, the heat of the heater 105 is conducted to the recording material S via the fixing film 102 and the toner image is fixed to the recording material S. The heater 105 is a planar heater such as a ceramic heater having a low heat capacity, for example. In a state where the fixing film 102 and the pressure roller 120 are in pressure contact with each other as described later, the heater 105 presses the pressure roller 120 via the fixing film 102 and contributes to forming the fixing nip portion N1.

A polyimide layer having a thickness of approximately 10 μm, for example, is formed as a sliding layer on the surface of the heater 105 that abuts against the inner circumferential surface of the fixing film 102. By forming the polyimide layer on the heater 105, sliding resistance between the fixing film 102 and the heater 105 can be reduced, and thereby, driving torque for rotating the fixing film 102 can be reduced, and abrasion caused by sliding of the fixing film 102 can also be reduced. According to the present embodiment, the conveyance direction length of the heater 105 is set to "approximately 8.75 mm" and the conveyance direction length along which the inner circumferential surface of the fixing film 102 slides against the heater 105 is set to "approximately 3 to 4 mm".

Temperature Sensor

According to the present embodiment, the temperature sensor 106 for detecting the temperature of the heater 105 is provided to manage the temperature of the fixing film 102. In the present embodiment, the contact-type temperature sensor 106 such as a thermistor sensor is adopted. However, the temperature sensor 106 can be a noncontact-type sensor. The temperature sensor 106 is arranged in the heater holder 103 so that the heat sensing portion contacts a back side of the heater 105 opposite the fixing film 102. The number of temperature sensors 106 is not limited to one, and multiple temperature sensors can be arranged along the width direction of the fixing film 102, that is, the rotational axis direction of the pressure roller 120.

Pressure Roller

The pressure roller 120 serving as a pressure member is supported rotatably on the apparatus body. The pressure roller 120 is arranged to be in pressure contact with the fixing film 102. The pressure roller 120 includes an elastic layer 122 made for example of a silicone rubber with a thickness of "approximately 3.5 mm" formed on an outer circumference of a core metal 121 formed of stainless steel, and a release layer 123 made of fluororesin such as PTFE, PFA, or FEP with a thickness of "approximately 45 to 65 μm" formed on an outer circumference of the elastic layer 122. An Asker C hardness of the pressure roller 120 is "approximately 60 degrees", for example.

As described above, the fixing nip portion N1 is formed by the fixing film 102 and the pressure roller 120 being in pressure contact with each other. Therefore, if the pressure roller 120 is rotated by a drive motor 124, the rotational force of the pressure roller 120 is conducted to the fixing film 102 by frictional force generated at the fixing nip portion N1. Thus, the fixing film 102 is driven to rotate by the pressure roller 120, which is so-called a pressure-roller drive method. The recording material S is nipped and conveyed by the fixing nip portion N1 formed by the rotating pressure roller 120 and the fixing film 102.

In the fixing unit 100 described above, the recording material S is conveyed to the fixing nip portion N1 in a state where the temperature of the heater 105 is controlled to a target temperature. The recording material S enters the fixing nip portion N1 with one side to which the toner image has been formed by the image forming unit 300 (refer to FIG. 1) facing the fixing film 102. While the recording material S passes through the fixing nip portion N1, the heat of the heater 105 is applied via the fixing film 102 to the recording material S, by which the toner image is fixed to the recording material S.

The fixing unit 1X) is arranged downstream of the secondary transfer portion T2 such that a most upstream portion of the fixing nip portion N1 is positioned "approximately 90 mm" from a most downstream portion of the secondary transfer portion T2. According to the present embodiment, a leading edge portion. i.e. downstream-side edge portion, of the recording material S reaches the fixing nip portion N1 before a trailing edge portion, i.e., upstream-side edge portion, of the recording material S passes the secondary transfer portion T2. Further according to the present embodiment, a post-secondary transfer sensor 191 that is capable of detecting the trailing edge portion of the recording material S to detect whether the recording material S has passed through the secondary transfer portion T2 is arranged downstream of the secondary transfer outer roller 14 and upstream of the fixing unit 100.

Conveyance Unit

Next, the conveyance unit 150 will be described with reference to FIG. 2. The conveyance unit 150 serving as a conveyance portion is arranged downstream of the fixing unit 100 in the conveyance direction, i.e., arrow X direction, and includes a pair of rotatable conveyance rollers 151 and 152. The conveyance rollers 151 and 152 are abutted against one another to form a conveyance nip portion N2 serving as a second nip portion for nipping and conveying the recording material S. The conveyance nip portion N2 is disposed adjacent to the fixing nip portion N1 in the conveying direction. According to the present embodiment, the conveyance roller 151 rotates by a drive motor 153, and the conveyance roller 152 is driven to rotate following the rotation of the conveyance roller 151. The recording material S is nipped and conveyed by the conveyance nip portion N2 formed by the conveyance rollers 151 and 152 being rotated.

The conveyance unit 150 is arranged downstream of the fixing unit 100 and positioned at a distance from the fixing unit 100 capable of nipping and conveying the recording material S before the trailing edge portion of the recording material S passes through the fixing nip portion N1. In other words, at a point of time when the leading edge portion of the recording material S reaches the most upstream portion of the conveyance nip portion N2, the trailing edge portion of the recording material S is still nipped and conveyed by the fixing nip portion N1. That is, according to the present embodiment, the recording material S being conveyed can be in a state nipped by both the fixing unit 100, specifically, the fixing nip portion N1, and the conveyance unit 150, specifically, the conveyance nip portion N2. For example, the conveyance unit 150 is arranged downstream of the fixing unit 100 such that the most upstream portion of the conveyance nip portion N2 is positioned at a distance of "approximately 50 mm" from the most downstream portion of the fixing nip portion N1. In other words, the distance between the conveyance nip portion N2 and the fixing nip portion N1 is shorter than the length of the recording material S of a smallest size that can be conveyed in the present image forming apparatus 1.

Further, according to FIG. 2, dotted line a is a straight line connecting the upstream end of the fixing nip portion N1 and the downstream end of the fixing nip portion N1, and dotted line b is a straight line connecting the downstream end of the fixing nip portion N1 and the upstream end of the conveyance nip portion N2. As illustrated in FIG. 2, the conveyance unit 150 is arranged so that the dotted line b is positioned toward the fixing film 102 than the dotted line a when viewed in the rotational axis direction of the pair of conveyance rollers 151 and 152. That is, the conveyance unit 150 is relatively positioned with respect to the fixing unit 100 so that the conveyance nip portion N2 is positioned toward the fixing film 102 from the fixing nip portion N1. It is preferable that the conveyance unit 150 is relatively positioned with respect to the fixing unit 100 so that the dotted line a and the dotted line b is overlapped.

Control Unit

As illustrated in FIG. 1, the image forming apparatus 1 includes a control unit 500. The control unit 500 will be described based on FIG. 3 with reference to FIG. 1. In addition to the illustrated components, various motors for driving respective components of the image forming unit 300 or various power supplies for applying voltage thereto are connected to the control unit 500. However, since they are not related to the main object of the present technique, they are not shown in the drawings and descriptions thereof are omitted.

The control unit 500 performs various controls of the image forming apparatus 1 such as the image forming operation, and for example, it includes a CPU (Central Processing Unit) 501 and a memory 502. The memory 502 is composed, for example, of a ROM (Read Only Memory) and a RAM (Random Access Memory) and stores various programs and various data for controlling the image forming apparatus 1. The CPU 501 can execute an image forming job (not shown) or a conveyance speed control (refer to FIG. 4 described later) stored in the memory 502, and can operate the image forming apparatus 1 to form images on the recording material S. The memory 502 can temporarily store computation processing results accompanying execution of various programs.

An operation unit 400 is connected via an input-output interface to the control unit 500. The operation unit 400 is, for example, an operation panel through winch the user is allowed to enter various programs such as an image forming job or enter various data. The user can use the operation unit 400 to enter the type and size of the recording material S as information related to the recording material S or to instruct an image forming job to be started. Further, it may be possible to select execution of a conveyance speed control, i.e., conveyance mode, described later.

The image forming job refers to a series of actions from the start of image forming operation to the completion of the image forming operation based on a print signal of forming an image on the recording material S. That is, it refers to a series of actions from when a preliminary action, so-called pre-rotation, that is required for image formation is started through the image forming process until a preliminary action, so-called post-rotation, that is required for ending the image formation is completed. Specifically, it refers to a series of actions from pre-rotation, i.e., preparation operation prior to image forming, that is performed after a print signal has been received, that is, after input of an image forming job, to post-rotation, that is, operation after the image formation, including the image forming period and interval between sheets.

Further, the above-mentioned drive motors 124 and 153, the post-secondary transfer sensor 191, the heater 105, the temperature sensor 106, and a temperature and humidity sensor 250 are connected via the input-output interface to the control unit 500. The control unit 500 controls the heater 105 based on the detection result of the temperature sensor 106, by which a surface temperature of the fixing film 102 during the image forming job can be maintained to a predetermined temperature. The temperature and humidity sensor 250 serving as a humidity detection unit can detect the temperature and humidity of the location where the image forming apparatus 1 is installed, and the control unit 500 can acquire the detection result of the temperature and humidity sensor 250.

The control unit 500 can control the drive motor 124 serving as a first drive unit and change the peripheral speed of the pressure roller 120 and consequently the fixing film 102. Thereby, a conveyance speed of the recording material S by the fixing unit 100, which is referred to as a fixing conveyance speed or first conveyance speed for convenience, is adjusted. Further, the control unit 500 can change the peripheral speed of the conveyance rollers 151 and 152 by controlling the drive motor 153 serving as a second drive unit. Thereby, the conveyance speed of the recording material S by the conveyance unit 150, which is referred to as a post-conveyance speed or second conveyance speed for convenience, is adjusted. In other words, the control unit 500 can vary the conveyance speeds of the recording material S between the fixing unit 100 and the conveyance unit 150. The control unit 50X) can specify, the position of the recording material S during conveyance between the secondary transfer portion T2 and the conveyance unit 150 based on the detection result of the post-secondary transfer sensor 191 serving as a conveyance detection unit, and the conveyance speeds of the recording material S by the fixing unit 100 and the conveyance unit 150 can be adjusted accordingly. By the adjustment of the conveyance speed of the recording material S, the position or states of conveyance of the recording material S during conveyance between the fixing unit 100 and the conveyance unit 150 can be changed.

When the trailing edge portion of the recording material S passes through the fixing nip portion N1, the trailing edge portion of the recording material S sometimes moves toward the fixing film 102, which is significant in a case where the conveyance nip portion N2 is positioned toward the fixing film 102 than the fixing nip portion N1 (FIG. 2). In that case, if the trailing edge portion of the recording material S becomes too close to the fixing film 102, spark discharge is generated at a portion of the surface of the fixing film 102. If spark discharge is generated, when a subsequent recording material S conveyed successively is passed through the fixing nip portion N1, toner on the recording material S may adhere to the fixing film 102 and cause image defects.

In consideration of the problems mentioned above, according to the present embodiment, the conveyance speeds of the recording material S at the fixing unit 100 and at the conveyance unit 150 are respectively adjusted to prevent the trailing edge portion of the recording material S from moving too close to the fixing film 102 so as not to cause spark discharge between the trailing edge portion of the recording material S and the fixing film 102. Hereafter, the conveyance speed control processing, i.e., conveyance mode, of the first embodiment for realizing this operation will be described based on FIGS. 4 to 6 with reference to FIGS. 2 and 3.

Conveyance Speed Control Processing

Figure 4:
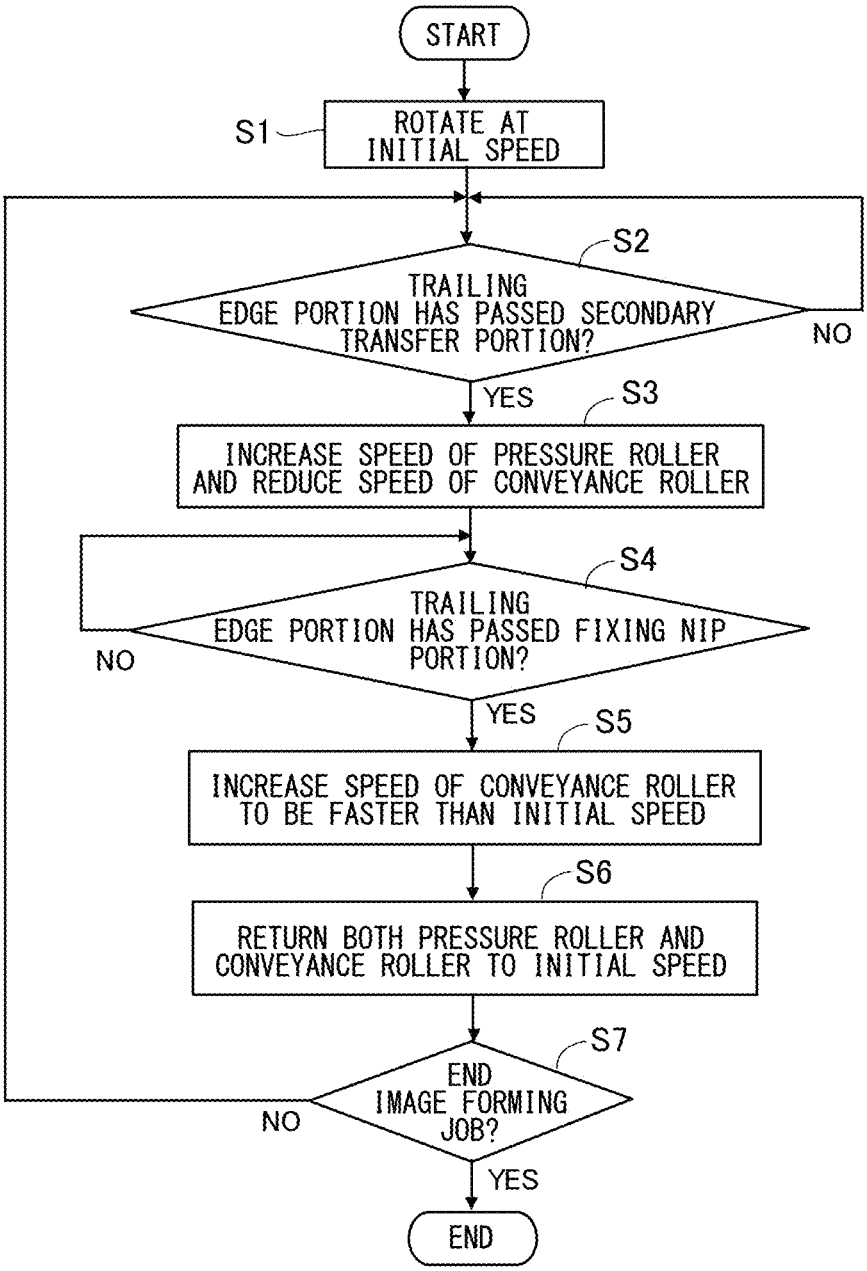
FIG. 4 is a flowchart illustrating a conveyance speed control processing according to the first embodiment.

FIG. 4 is a flowchart illustrating the conveyance speed control processing according to the first embodiment. The conveyance speed control processing according to the present embodiment is executed during an image forming job performed by the control unit 500 in response to an input of instruction to start the image forming job.

As illustrated in FIG. 4, the control unit 500 controls the drive motor 124 and the drive motor 153 so that the peripheral speed of the pressure roller 120 and the peripheral speed of the conveyance roller 151 are set to different initial speeds according to the process speed of the image forming unit 300 (refer to FIG. 1) (S1). In this state, the control unit 500 controls the drive motor 124 and the drive motor 153 so that the post-conveyance speed of the conveyance unit 150 is set faster than the fixing conveyance speed of the fixing unit 100 before the leading edge portion of the recording material S reaches the fixing nip portion N1. That is, when the fixing conveyance speed of the fixing unit 100 is denoted by Vf and the post-conveyance speed of the conveyance unit 150 is denoted by Ve, a relative speed difference ΔV (Ve−Vf) is set to be greater than 0 (ΔV>0).

Thereafter, the control unit 500 determines whether the trailing edge portion of the recording material S has passed through the secondary transfer portion T2 based on the detection result of the post-secondary transfer sensor 191 (S2). In the present embodiment, it is assumed that the trailing edge portion of the recording material S had passed the secondary transfer portion T2 when the trailing edge portion of the recording material S has been detected by the post-secondary transfer sensor 191. In a state where the trailing edge portion of the recording material S has not passed the secondary transfer portion T2 (S2: NO), the control unit 500 maintains a state where the post-conveyance speed of the conveyance unit 150 is faster than the fixing conveyance speed of the fixing unit 100 (ΔV>0).

In a state where the trailing edge portion of the recording material S has passed through the secondary transfer portion T2 (S2: YES), the control unit 500 controls the drive motor 124 and the drive motor 153 so as to increase the peripheral speed of the pressure roller 120 and reduce the peripheral speed of the conveyance roller 151 (S3). At this time, the control unit 500 reduces the post-conveyance speed of the conveyance unit 150 compared to the fixing conveyance speed of the fixing unit 100. That is, the relative speed difference ΔV between the fixing conveyance speed Vf of the fixing unit 100 and the post-conveyance speed Ve of the conveyance unit 150 is set to be smaller than 0 (ΔV<0).

Then, the control unit 500 determines whether the trailing edge portion of the recording material S has passed through the fixing nip portion N1 (S4). The control unit 500 can determine whether the trailing edge portion of the recording material S has passed through the fixing nip portion N1 based, for example, on the detection result of the post-secondary transfer sensor 191, that is, the time at which the trailing edge portion of the recording material S has passed the secondary transfer portion T2, the conveyance direction length of the recording material S. and the fixing conveyance speed of the fixing unit 100.

If the trailing edge of the recording material S has not passed the fixing nip portion N1 (S4: NO), the control unit 500 maintains a state where the post-conveyance speed Ve of the conveyance unit 150 is slower than the fixing conveyance speed Vf of the fixing unit 100 (ΔV<0). Meanwhile, if the trailing edge portion of the recording material S has passed the fixing nip portion N1 (S4: YES), the control unit 500 controls the drive motor 153 to temporarily set the post-conveyance speed Ve of the conveyance unit 150 to be faster than the initial speed (S5). That is, the post-conveyance speed of the conveyance unit 150 is faster than the fixing conveyance speed of the fixing unit 100 (ΔV>0), but compared to a state where the trailing edge portion of the recording material S is passing through the secondary transfer portion T2 (refer to S1), the relative speed difference ΔV is set to be greater.

After temporarily setting the post-conveyance speed Ve to be faster than the speed before the speed reduction, the control unit 500 controls the drive motor 124 to return the fixing conveyance speed Vf of the fixing unit 100 to the initial speed and controls the drive motor 153 to return the post-conveyance speed Vc of the conveyance unit 150 to the initial speed (S6). As described, the conveyance speed control of one sheet of recording material S is performed. Thereafter, the control unit 500 determines whether to end the image forming job being executed (S7). If the image forming job is not to be ended (S7: NO), the control unit 500 returns to the process of step S2 and performs the above-mentioned processes of steps S2 to S7 to perform a conveyance speed control of the subsequent recording material S in succession thereto. If the image forming job is to be ended (S7: YES), there is no subsequent recording material S in succession thereto, so the control unit 500 ends the conveyance speed control processing.

Figure 5:
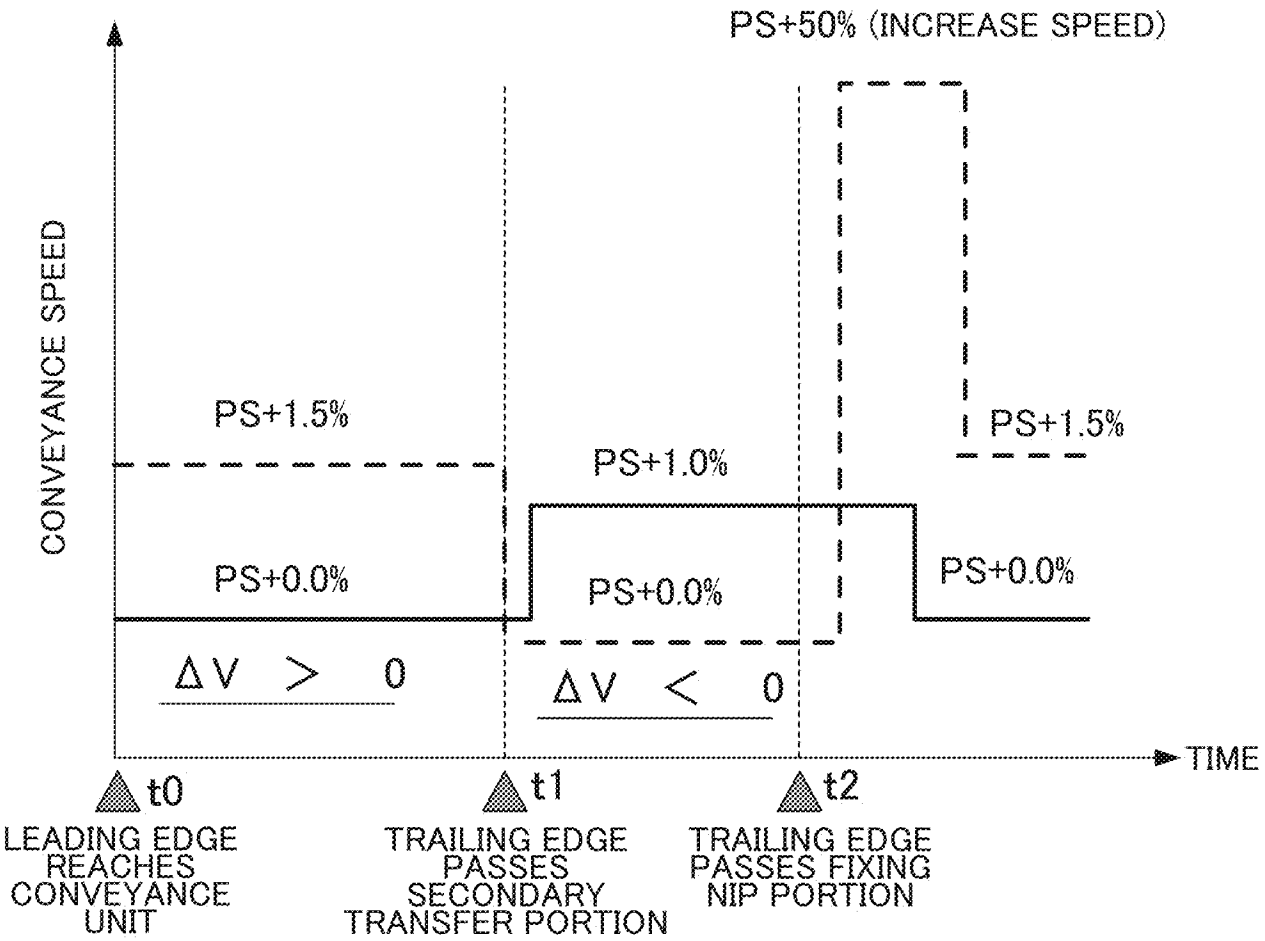
FIG. 5 is a timing chart of conveyance speed control per sheet of recording material according to the first embodiment.
Figure 6:
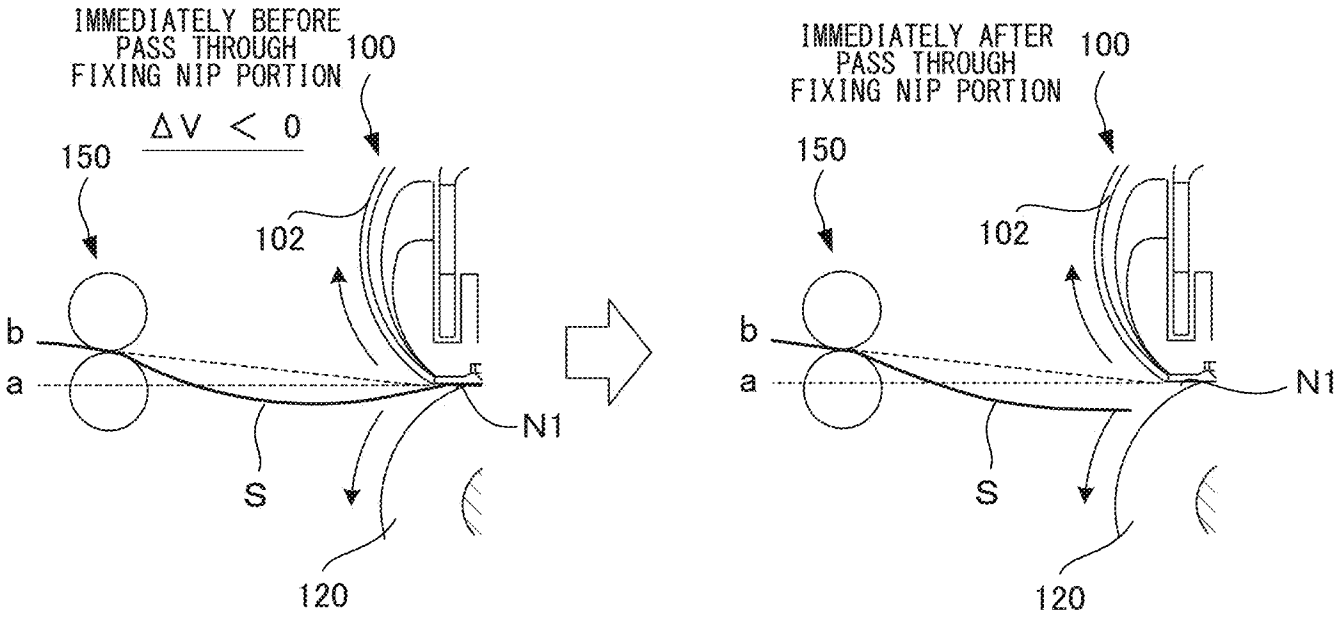
FIG. 6 is a view illustrating a state of conveyance of the recording material according to the first embodiment.

The conveyance speed control processing of the present embodiment illustrated in FIG. 4 will be described in detail. FIG. 5 is a timing chart of conveyance speed control per sheet of recording material according to the present embodiment, and FIG. 6 illustrates a state of conveyance of the recording material S according to the present embodiment. A case where a processing speed (hereinafter referred to as PS) of the image forming unit 300 (refer to FIG. 1) is set to "300 mm/sec" is taken as an example. In FIG. 5, the peripheral speed of the pressure roller 120 is shown by a solid line, and the peripheral speed of the conveyance roller 151 is shown by a dotted line.

As illustrated in FIG. 5, the pressure roller 120 is rotated at a peripheral speed of "300 mm/sec (PS+0.0%)" in response to the processing speed of the image forming unit 300 before the leading edge portion of the recording material S reaches the fixing nip portion N1 (refer to S1). Meanwhile, the conveyance roller 151 is rotated at a peripheral speed of "305 mm/sec (PS+1.5%)" in response to the processing speed of the image forming unit 300 before the leading edge portion of the recording material S reaches the fixing nip portion N1 (refer to S1). That is, the relative speed difference ΔV (Ve−Vf) between the fixing conveyance speed Vf of the fixing unit 100 and the post-conveyance speed Ve of the conveyance unit 150 is greater than 0. Thus, it becomes possible to suppress the winding of recording material S around the fixing film 102 and the waving of the recording material S during conveyance. Until the trailing edge portion of the recording material S passes through the secondary transfer portion 12 (time t1), the post-conveyance speed of the conveyance unit 150 is maintained at a fast state compared to the fixing conveyance speed of the fixing unit 100 (ΔV>0).

At a timing when the trailing edge portion of the recording material S is passed through the secondary transfer portion T2 (time t1), that is, at a timing when the trailing edge portion of the recording material S is detected by the post-secondary transfer sensor 191, the peripheral speed of the pressure roller 120 is increased to "303 mm/sec (PS+1.0%)" (refer to S3). At the same time, the peripheral speed of the conveyance roller 151 is reduced to "300 mm/sec (PS+0.0%)" (refer to S3). In other words, the post-conveyance speed Ve of the conveyance unit 150 is reduced compared to the fixing conveyance speed Vf of the fixing unit 100, and the relative speed difference ΔV is set smaller than 0 (ΔV<0). In this state, the recording material S is not nipped by the secondary transfer portion T2 but nipped by both the fixing unit 100, specifically the fixing nip portion N1, and the conveyance unit 150, specifically the conveyance nip portion N2.

Then, after the trailing edge portion of the recording material S has passed through the fixing nip portion N1 (time t2, refer to S4), the peripheral speed of the conveyance roller 151 is temporarily increased to "450 mm/sec (PS+50%)" so as to discharge the recording material S speedily (refer to S5). Then, the peripheral speed of the pressure roller 120 is returned to "300 mm/sec (PS+0.0%)", and the peripheral speed of the conveyance roller 151 is returned to "305 mm/sec (PS+1.5%)" (refer to S6). At this time, the respective peripheral speeds are returned to the "initial speed" described above before the leading edge portion of the subsequent recording material S reaches the fixing nip portion N1.

As described, according to the present embodiment, before the trailing edge portion of the recording material S is passed though the fixing nip portion N1, at a first timing during which the recording material S is passing through the fixing nip portion N1, the post-conveyance speed Ve of the conveyance unit 150 is reduced compared to the fixing conveyance speed Vf of the fixing unit 100 (ΔV<0). Thereby, as illustrated in FIG. 6, the recording material S can be conveyed while having the recording material S curve toward the pressure roller 120, that is, so that a loop is formed in the recording material S toward the pressure roller 120, between the fixing unit 100 and the conveyance unit 150 in a state where the recording material S is nipped by both the fixing unit 100 and the conveyance unit 150. In a case where the recording material S is conveyed while being curved toward the pressure roller 120, the trailing edge portion of the recording material S is prevented from being moved toward the fixing film 102 when the recording material S is passed through the fixing nip portion N1.

According to the present embodiment, the recording material S is conveyed so as not to form a loop between the fixing nip portion N1 and the conveyance nip portion N2 until a predetermined timing during passing of the fixing nip portion N1 is reached. Further, from after the leading edge portion of the recording material S had reached the conveyance nip portion N2 until the above-mentioned first timing has been reached, the post-conveyance speed Ve of the conveyance unit 150 is set greater than the fixing conveyance speed Vf of the fixing unit 100. Further, after the trailing edge portion of the recording material S had passed through the fixing nip portion N1, from a second timing before the trailing edge portion of the recording material S is passed through the conveyance nip portion N2 until the trailing edge portion of the recording material S is passed through the conveyance nip portion N2, the post-conveyance speed Ve of the conveyance unit 150 is greater than the fixing conveyance speed Vf of the fixing unit 100.

The timing of reducing the post-conveyance speed Ve of the conveyance unit 150 than the fixing conveyance speed Vf of the fixing unit 100 should preferably be set so that the speed is changed after the trailing edge portion of the recording material S had passed through the secondary transfer portion T2 and before it is passed through the fixing nip portion N1 (refer to time t1 to time t2 of FIG. 5). That is, according to the present embodiment, during execution of the conveyance speed control processing, i.e., during conveyance mode, "ΔV>0" is realized until the trailing edge portion of the recording material S passes through the secondary transfer portion T2, and after the trailing edge portion of the recording material S has passed through the secondary transfer portion T2, "ΔV<0" is realized. This is due to the following reason.

As illustrated in FIG. 6, in order to curve the recording material S toward the pressure roller 120, the relative speed difference ΔV must be smaller than 0 (ΔV<0). It may be possible to realize the state of "ΔV<0" immediately after the leading edge portion of the recording material S has reached the conveyance nip portion N2. However, in that case, the recording material S tends to curve excessively toward the pressure roller 120, and the recording material S being conveyed may be wound around the fixing film 102 or the recording material S may be waved during conveyance. Further, if the state of "ΔV<0" is realized while the recording material S is passed through the secondary transfer portion T2, the behavior of the recording material S at the secondary transfer portion T2 may vary, and image defects may occur.

In consideration of the above drawbacks, according to the present embodiment, control is performed to realize "ΔV<0" while the trailing edge portion of the recording material S passes through an area between the secondary transfer portion T2 and the fixing nip portion N1. In other words, according to the conveyance speed control of the present embodiment, the post-conveyance speed Ve of the conveyance unit 150 and the fixing conveyance speed Vf of the fixing unit 100 are adjusted so that "ΔV>0" is realized when the leading edge portion of the recording material S is passed through the above area and "ΔV<0" is realized when the trailing edge portion of the recording material S is passed through the same area. Thereby, a loop can be formed on the recording material S between the fixing unit 100 and the conveyance unit 150 while preventing winding or waving of the recording material S. By forming a loop on the recording material S, movement of the trailing edge portion of the recording material S toward the fixing film 102 can be suppressed while the recording material S passes through the fixing nip portion N1.

Comparison Example

Figure 7:
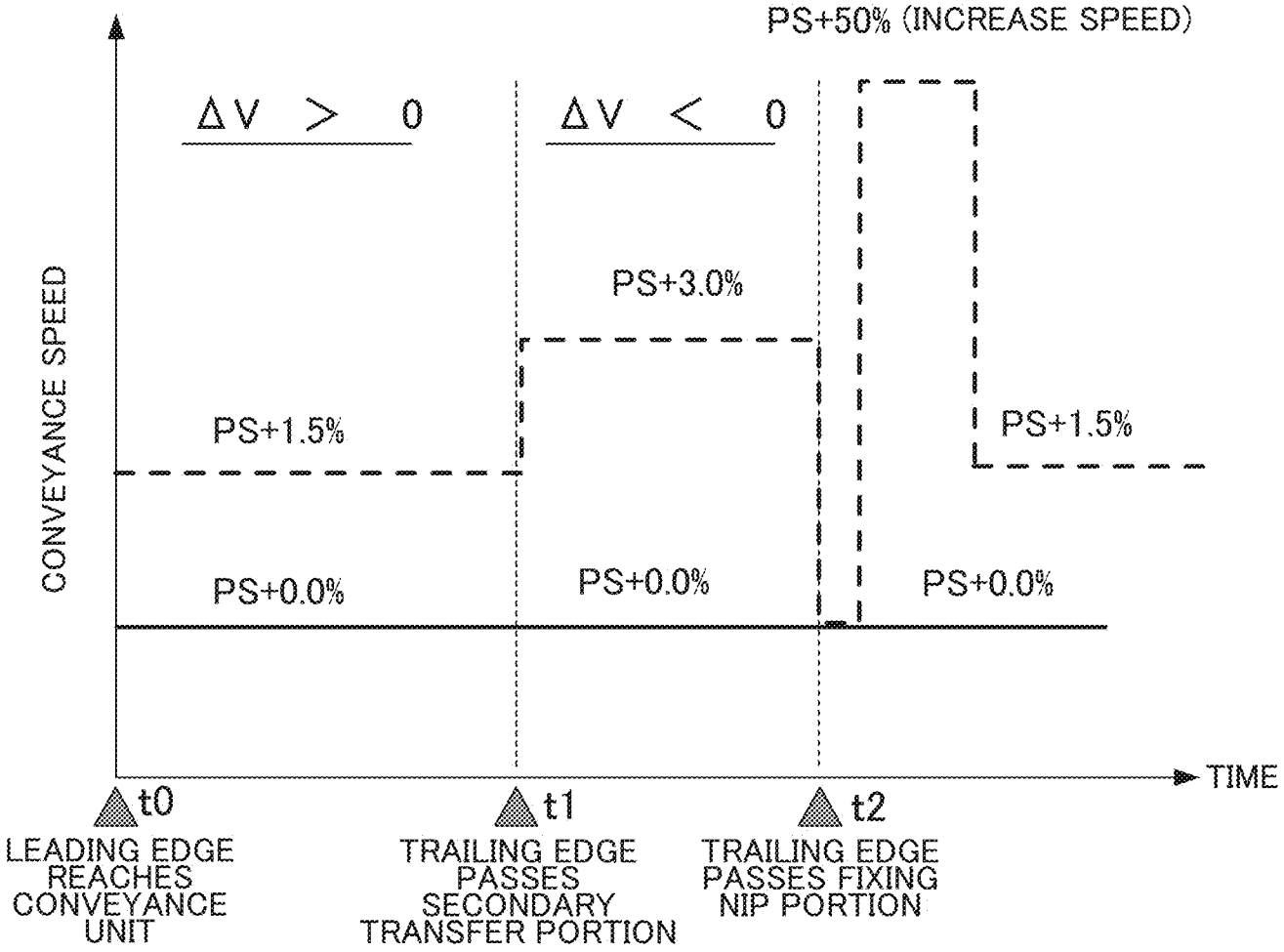
FIG. 7 is a timing chart of conveyance speed control per sheet of recording material according to a comparison example.
Figure 8:
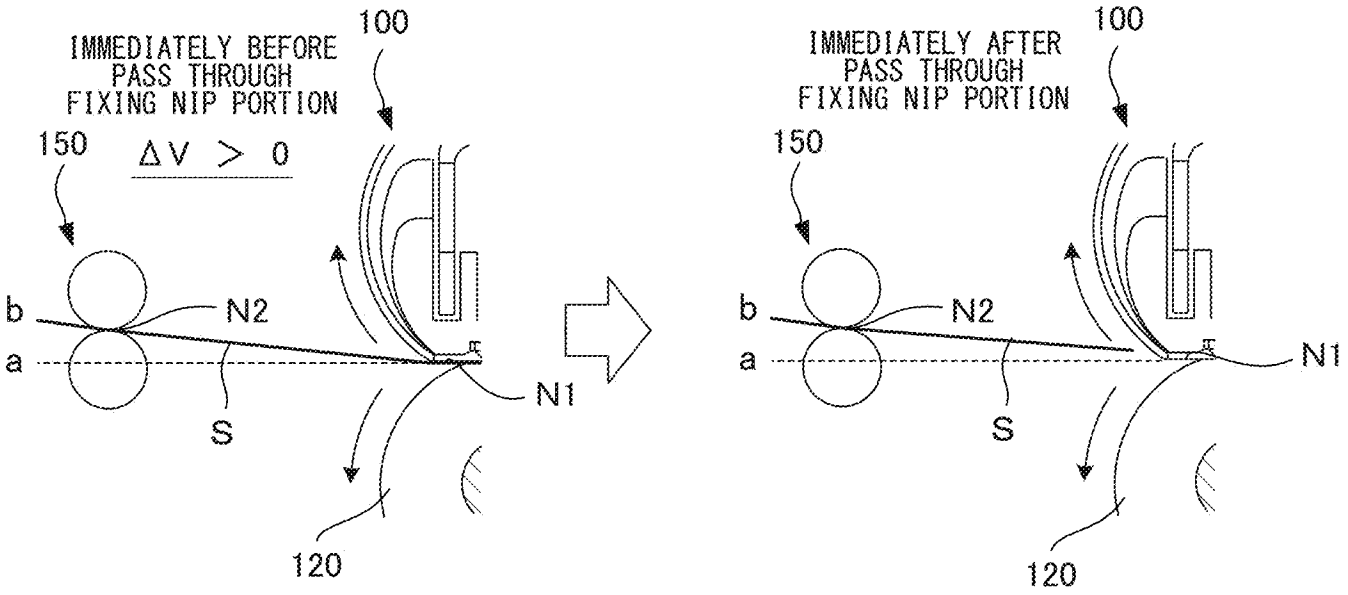
FIG. 8 is a view illustrating a state of conveyance of a recording material according to the comparison example.

Now, a comparison example is illustrated for comparison with the embodiment described above. FIG. 7 is a timing chart of conveyance speed control per sheet of recording material according to the comparison example, and FIG. 8 illustrates a state of conveyance of the recording material S according to the comparison example. In FIG. 7, the peripheral speed of the pressure roller 120 is shown by a solid line, and the peripheral speed of the conveyance roller 151 is shown by a dotted line.

As illustrated in FIG. 7, according to the comparison example, the post-conveyance speed Ve of the conveyance unit 150 and the fixing conveyance speed Vf of the fixing unit 100 are adjusted so that the relative speed difference ΔV does not fall below 0 (ΔV<0) and that the relative speed difference ΔV is maintained to be greater than 0 (ΔV>0). In the comparison example, the pressure roller 120 is rotated at a peripheral speed of "300 mm/sec (PS+0.0%)" and the conveyance roller 151 is rotated at a peripheral speed of "305 mm/sec (PS+1.5%)", similarly as the present embodiment, until the trailing edge portion of the recording material S passes through the secondary transfer portion T2 (time t1).

When the trailing edge portion of the recording material S passes through the secondary transfer portion T2 (time t1), the peripheral speed of the conveyance roller 151 is increased to "309 mm/sec (PS+3.0%)" ile the peripheral speed of the pressure roller 120 is maintained. In this state, the relative speed difference ΔV is greater than 0 (ΔV>0), hereafter, when the trailing edge portion of the recording material S passes through the fixing nip portion N1 (time t2), the peripheral speed of the conveyance roller 151 is increased to "450 mm/sec (PS+50%)" to discharge the recording material S speedily. As described, according to the comparison example, the post-conveyance speed Ve of the conveyance unit 150 and the fixing conveyance speed Vf of the fixing unit 100 are adjusted to maintain the state of "ΔV>0" during conveyance of the recording material S. As illustrated in FIG. 7, according to the comparison example, the peripheral speed of the pressure roller 120 is maintained at "300 mm/sec (PS+0.0%)" and the peripheral speed of the conveyance roller 151 is changed arbitrarily so as not to fall below "300 mm/sec".

According to the comparison example, the post-conveyance speed Ve of the conveyance unit 150 is always faster than the fixing conveyance speed Vf of the fixing unit 100 (ΔV>0), so that as illustrated in FIG. 8, the recording material S is conveyed along a straight line (dotted line b) connecting the most downstream portion of the fixing nip portion N1 and the most upstream portion of the conveyance nip portion N2. According to the comparison example, there is an advantage in that the recording material S will not be slacked during conveyance and that the waving of the recording material S can be prevented. However, if the trailing edge portion of the recording material S passes through the fixing nip portion N1 while the post-conveyance speed Ve is faster than the fixing conveyance speed Vf, the trailing edge portion of the recording material S will become excessively close to the fixing film 102 and spark discharge may be generated at a portion of the surface of the fixing film 102.

As described, according to the present embodiment, the relative speed difference ΔV between the post-conveyance speed Ve of the conveyance unit 150 and the fixing conveyance speed Vf of the fixing unit 100 is set smaller than 0 (ΔV<0) before the trailing edge portion of the recording material S passes through the fixing nip portion N1, and the recording material S is curved toward the pressure roller 120. That is, in a state where the recording material S is nipped by both the fixing unit 100 and the conveyance unit 150, the recording material S is conveyed in a state curved toward the pressure roller 120 between the fixing unit 100 and the conveyance unit 150. Thereby, when the recording material S passes through the fixing unit 100, the trailing edge portion of the recording material S can be suppressed from moving toward the fixing film 102 arranged on one side of the recording material S on which the toner image is formed. Therefore, the trailing edge portion of the recording material S will not become too close to the fixing film 102, and spark discharge will not be generated at a portion of the surface of the fixing film 102. In other words, generation of discharge between the trailing edge of the recording material S and the fixing film 102 can be reduced while suppressing the influence on the conveyance property of the recording material S.

According to the above-described embodiment, at a timing when the trailing edge portion of the recording material S has passed through the secondary transfer portion T2, the fixing conveyance speed Vf of the fixing unit 100 is increased and the post-conveyance speed Ve of the conveyance unit 150 is reduced (refer to S3 of FIG. 4) to realize "ΔV<0", but the present technique is not limited thereto. The characteristic feature of the present technique is to adjust the relative speed difference (ΔV) of the fixing conveyance speed Vf and the post-conveyance speed Ve to "ΔV<0", so that the relative speed difference "ΔV<0" can be realized by adopting an alternative control as illustrated in Table 1 shown below.

TABLE 1

| | FIXING CONVEYANCE SPEED | POST-CONVEYANCE SPEED | RELATIVE SPEED DIFFERENCE ΔV |
|---|---|---|---|
| PRESENT EMBODIMENT | PS+1.0% | PS+0.0% | −1.0% |
| ALTERNATIVE CONTROL 1 | PS+0.0% | PS−1.0% | −1.0% |
| ALTERNATIVE CONTROL 2 | PS+2.5% | PS+1.5% | −1.0% |

For example, as shown in alternative control 1, the relative speed difference "ΔV<0" can be realized by maintaining the fixing conveyance speed Vf to "300 mm/sec (PS+0.0%)", i.e., initial speed, and reducing the post-conveyance speed Ve to "297 mm/sec (PS−1.0%)". Further, as shown in alternative control 2, the relative speed difference "ΔV<0" can be realized by maintaining the post-conveyance speed Ve to "305 mm/sec (PS+1.5%)", i.e., initial speed, and increasing the fixing conveyance speed Vf to "308 mm/sec (PS+2.5%)". An example of a case where the magnitude of the relative speed difference ΔV is the same (−1.0%) has been illustrated, but the magnitude of the relative speed difference ΔV can vary. If the relative speed difference (ΔV) is great, an amount of curving, or amount of looping, of the recording material S can be increased compared to when the relative speed difference is small.

Further according to the present embodiment, a period of time during which a state of "ΔV<0" is realized is shortened if the timing of reducing the post-conveyance speed Ve with respect to the fixing conveyance speed Vf is delayed within the period of time from passing of the trailing edge portion of the recording material S through the secondary transfer portion T2 to passing thereof through the fixing nip portion N1. If the period of time during which the state of "ΔV<0" is short, the amount of curving of the recording material S curved between the fixing unit 100 and the conveyance unit 150 can be reduced compared to when the period of time is long. Thus, the amount of curving of the recording material S can be adjusted not only by varying the magnitude of the relative speed difference ΔV described earlier but also by varying the timing of realizing the state of "ΔV<0" by switching the post-conveyance speed Ve or the fixing conveyance speed Vf.

Second Embodiment

Figure 3:
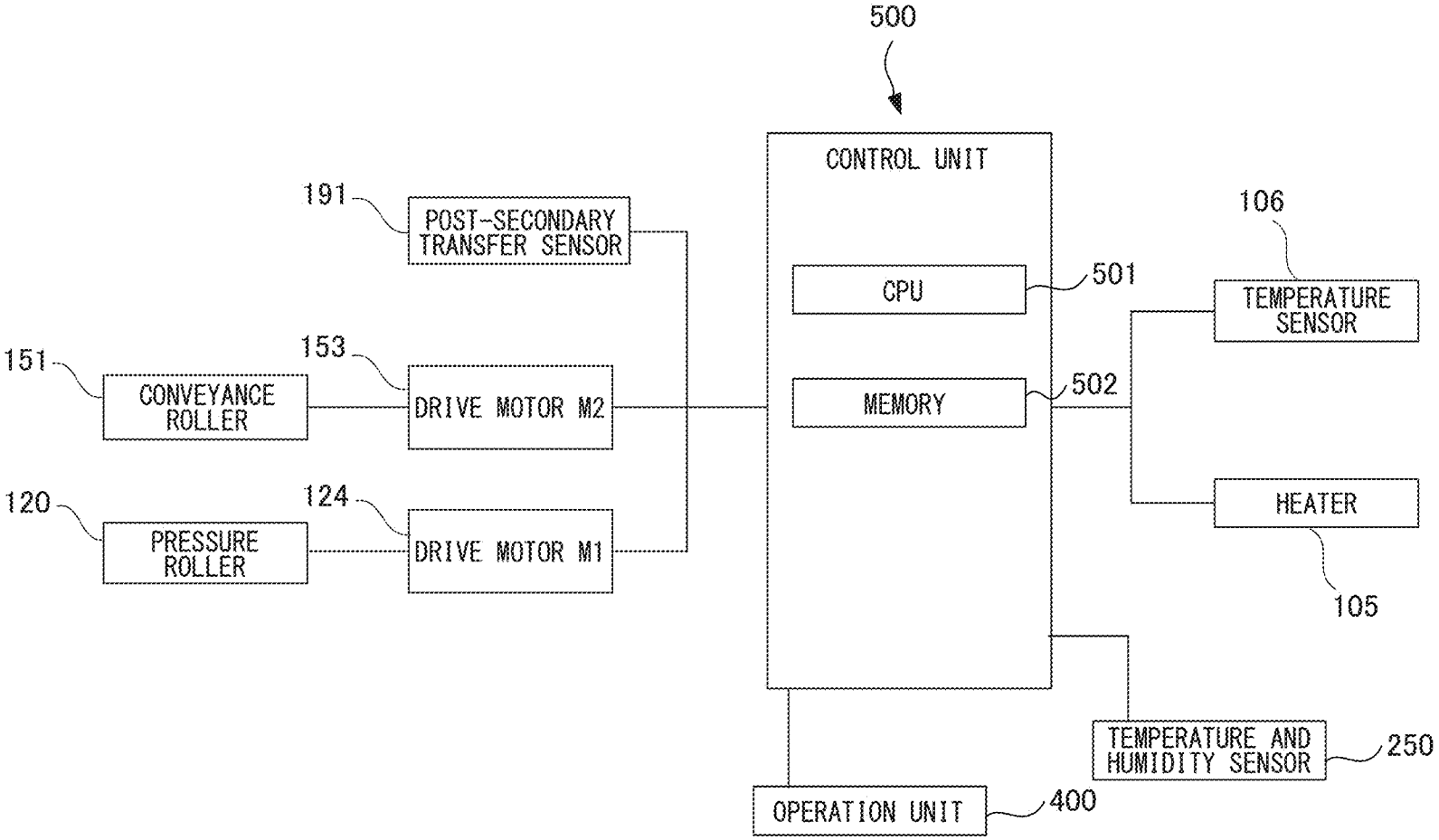
FIG. 3 is a control block diagram illustrating a control unit.
Figure 9:
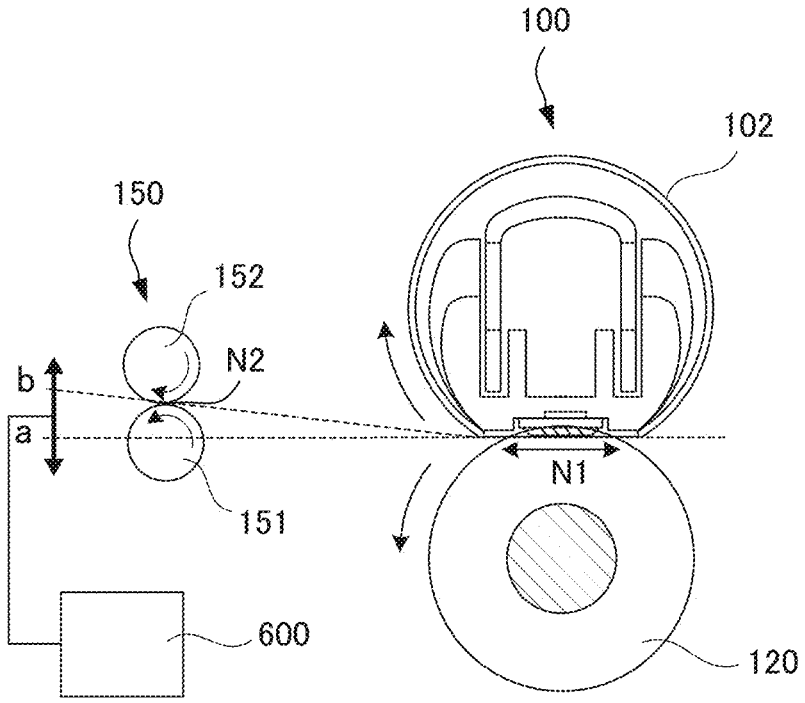
FIG. 9 is a schematic view illustrating a fixing unit and a conveyance unit that can be moved by a movement mechanism according to a second embodiment.

Next, a second embodiment will be described based on FIG. 9 with reference to FIGS. 1 and 3. As illustrated in FIG. 9, according to the image forming apparatus 1 described above, there is a case where the conveyance unit 150 is disposed movably in a vertical direction by a movement mechanism 600. According to this arrangement, during the conveyance mode mentioned earlier, the control unit 500 moves the conveyance unit 150 toward the pressure roller 120, i.e., downward in the vertical direction, via the movement mechanism 600 serving as a moving unit, before the trailing edge portion of the recording material S passes through the fixing nip portion N1.

Specifically, if the conveyance nip portion N2 is positioned toward the fixing film 102 from a straight line, dotted line a, that passes the fixing nip portion N1 when viewed in the rotational axis direction of the conveyance rollers 151 and 152, the conveyance unit 150 is moved toward the pressure roller 120 before the trailing edge portion of the recording material S has passed through the fixing nip portion N1. Then, after the trailing edge portion of the recording material S passes through the conveyance unit 150, the control unit 500 moves the conveyance unit 150 upward in the vertical direction to return the conveyance unit 150 to the original position by the movement mechanism 600.

As described, by moving the conveyance unit 150 toward the pressure roller 120, the amount of curving, or amount of looping, of the recording material S can be increased compared to when only the relative speed difference ΔV is adjusted, and the recording material S can be curved in a short time. Therefore, even according to the configuration described above, when the recording material S passes through the fixing unit 100, movement of the trailing edge portion of the recording material S toward the fixing film 102 positioned on one side of the recording material S to which the toner image is formed can be suppressed. As described, even according to the second embodiment, a similar effect as the first embodiment of reducing the generation of discharge between the trailing edge of the recording material S and the fixing film 102 while suppressing the influence on the conveyance property of the recording material S can be achieved.

Third Embodiment

Figure 10:
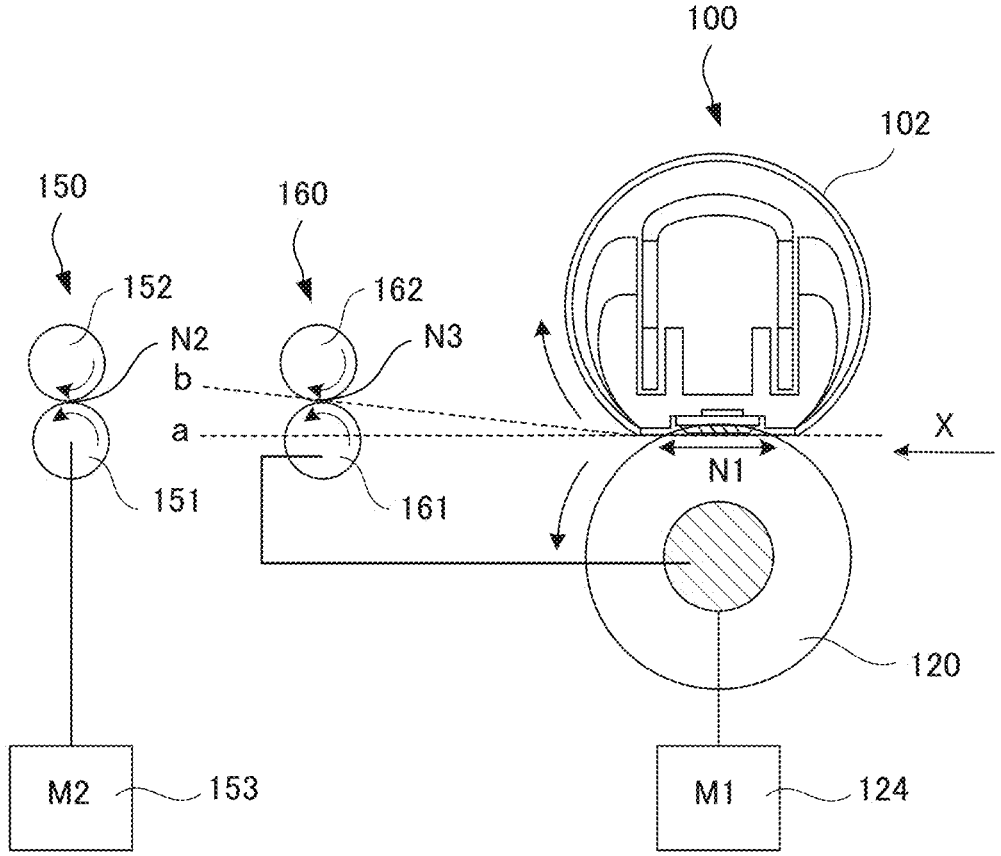
FIG. 10 is a schematic view illustrating a fixing unit, a conveyance unit and an auxiliary conveyance unit according to a third embodiment.

Next, a third embodiment will be described. As illustrated in FIG. 10, according to the present embodiment, an auxiliary conveyance unit 160 including a pair of auxiliary rollers 161 and 162 for nipping and conveying the recording material S is provided between the fixing unit 100 and the conveyance unit 150 in the direction of conveyance of the recording material S, i.e., arrow X direction. In the auxiliary conveyance unit 160 serving as an auxiliary conveyance portion, a peripheral speed of the auxiliary roller 161 is set faster than a peripheral speed of the pressure roller 120 by the drive motor 124 driving the pressure roller 120, and the auxiliary roller 161 is rotated with a predetermined speed difference by interlocking with the pressure roller 120. That is, the auxiliary roller 161 and the pressure roller 120 are coupled via a gear not shown to the drive motor 124. The auxiliary roller 162 is driven to rotate following the rotation of the auxiliary roller 161.

Figure 11:
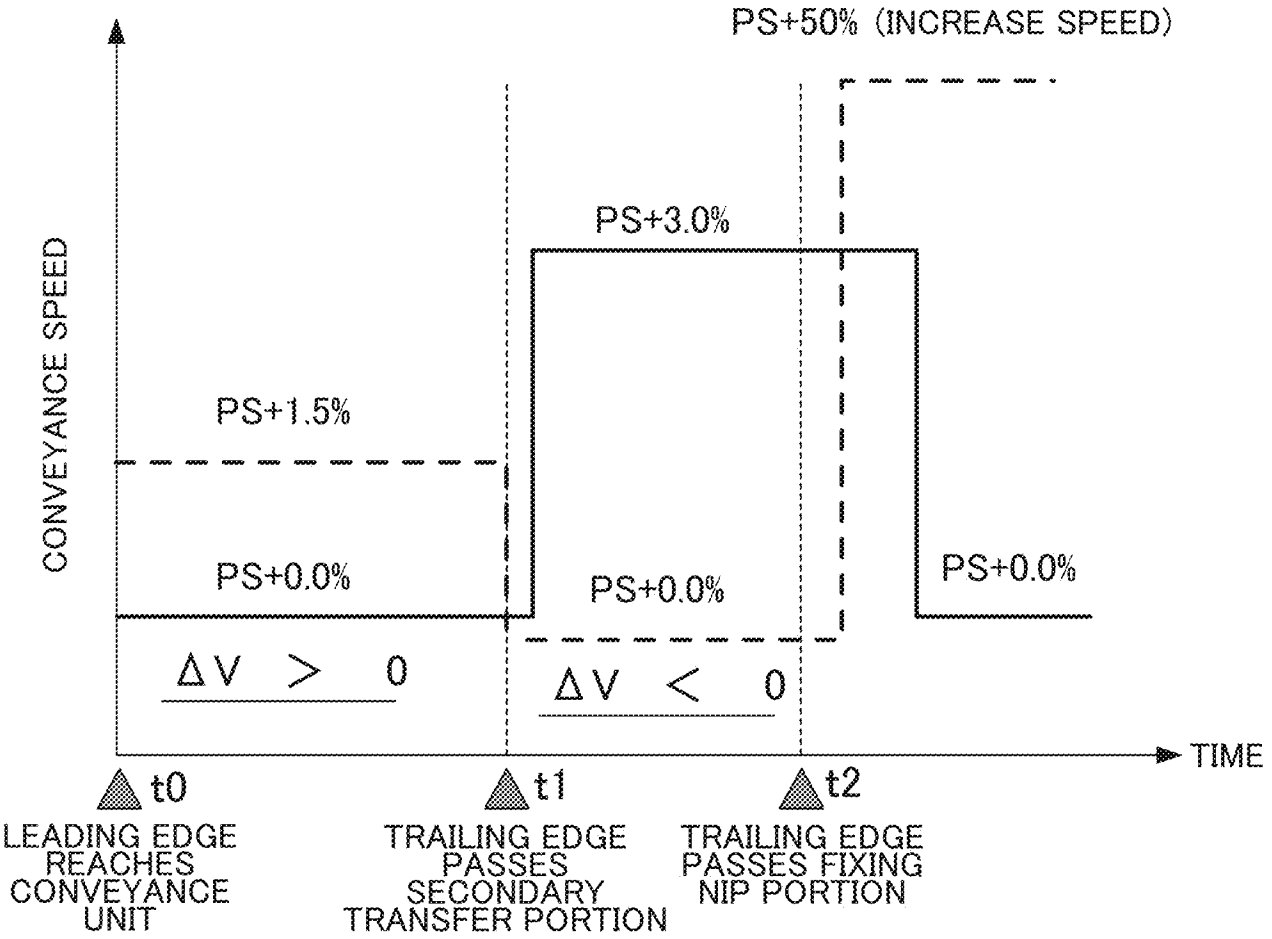
FIG. 11 is a timing chart of conveyance speed control per sheet of recording material according to the third embodiment.

The conveyance speed control according to the present embodiment will be described based on FIG. 11 with reference to FIGS. 1, 3, and 10. Similar to the first embodiment described earlier, the control unit 500 controls the drive motor 124 and the drive motor 153 so that a peripheral speed of the pressure roller 120 is increased while a peripheral speed of the conveyance roller 151 is decreased at a timing at which the trailing edge portion of the recording material S has passed through the post-secondary transfer sensor 191. Specifically, regarding the pressure roller 120, the peripheral speed is increased to "309 mm/sec (PS+3.0%)" by the drive motor 124, and regarding the conveyance roller 151, the peripheral speed is reduced to "300 mm/sec (PS+0.0%)" by the drive motor 153. That is, compared to the first embodiment (303 mm/sec (PS+1.0%)), the peripheral speed of the pressure roller 120 is high. In other words, the relative speed difference ΔV (Ve−Vf) between the fixing conveyance speed Vf of the fixing unit 100 and the post-conveyance speed Ve of the conveyance unit 150 is set to be smaller than 0 (ΔV<0), but compared to the first embodiment, the absolute value of the relative speed difference ΔV is set to be greater.

Further according to the present embodiment, the auxiliary rollers 161 and 162 serving as auxiliary rotary portion are abutted against each other to form a nip portion N3 that conveys the recording material S, but a pressure applied at the nip portion N3 is smaller than a pressure applied at the conveyance nip portion N2. Therefore, compared to the first embodiment described earlier, by setting the absolute value of the relative speed difference ΔV to be greater, the recording material S is curved between the conveyance unit 150 and the auxiliary conveyance unit 160 and a first loop is formed thereby. Further, in response to the formation of the first loop, the recording material S is further curved between the auxiliary conveyance unit 160 and the fixing unit 100 and a second loop is formed thereby. As described, even if the auxiliary conveyance unit 160 is provided between the fixing unit 100 and the conveyance unit 150, the recording material S can be curved between the fixing unit 100 and the auxiliary conveyance unit 160. Therefore, even according to the above configuration, movement of the trailing edge portion of the recording material S toward the fixing film 102 arranged on one side of the recording material S to winch the toner image is formed can be suppressed when the recording material S passes through the fixing unit 100. That is, a similar effect as the first embodiment of reducing the generation of discharge between the trailing edge of the recording material S and the fixing film 102 while suppressing the influence on the conveyance property of the recording material S can be achieved.

Other Embodiments

It is possible to set the conveyance speed control described above to be executed during an image forming job only when a user selects execution thereof. That is, as a normal conveyance speed control during an image forming job, as described in the comparison example illustrated earlier, the post-conveyance speed Ve of the conveyance unit 150 is always set to be faster than the fixing conveyance speed Vf of the fixing unit 100 ($\Delta V>0$), according to which the winding or waving of the recording material S is prevented. Then, the conveyance speed control according to the present embodiment can be executed only when the execution of the conveyance speed control is selected by the user through the operation unit 400 as an avoidance mode when image defects caused by discharge generated by the trailing edge portion of the recording material S approaching the fixing film 102 occur.

The image defects mentioned above caused by discharge tend to occur when the humidity of the environment is low or when the recording material S has high resistance and low moisture content. Therefore, the conveyance speed control according to the present embodiment can be set to be executed automatically based, for example, on the detection result of the temperature and humidity sensor 250 or the grammage corresponding to the type of the recording material S. For example, the conveyance speed control according to the present embodiment is executed automatically when the grammage of the recording material is greater than a predetermined value. As described, by automatically executing the conveyance speed control, both prevention of winding and waving of the recording material S and suppression of image defects caused by discharge can be realized without applying any stress to the user.

In addition to using the operation unit 400 to enter the instruction for setting the "conveyance mode" described above, the user can be enabled to enter an instruction to set "a different conveyance mode" of conveying the recording material S without forming a loop between the fixing nip portion N1 and the conveyance nip portion N2. If an instruction to set a different conveyance mode is entered, during the image forming job, the control unit 500 conveys the recording material S so that a loop is not formed between the fixing nip portion N1 and the conveyance nip portion N2 regardless of the grammage of the recording material.

According to the above-described embodiments, the heater 105 abutted against the fixing film 102 to heat the fixing film 102 has been illustrated as an example, but the present technique is not limited thereto, and a halogen lamp (halogen heater) or an infrared heater that heats the fixing film 102 without abutting against the fixing film 102 can be used.

According to the above-described embodiments, an image forming apparatus 1 adopting a configuration where color images of respective colors are primarily transferred from the photosensitive drums 2Y to 2K of respective colors to the intermediate transfer belt 8 and thereafter collectively secondarily transferring the colored toner images to the recording material S has been illustrated as an example, but the present technique is not limited thereto. For example, a direct transfer-type image forming apparatus where toner images are directly transferred from the photosensitive drums 2Y to 2K to the recording material S can be adopted.

Embodiment(s) of the present invention can also be realized by a computer of a system or apparatus that reads out and executes computer executable instructions (e.g., one or more programs) recorded on a storage medium (which may also be referred to more fully as a "non-transitory computer-readable storage medium") to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-147943, filed Sep. 3, 2020, which is hereby incorporated by reference herein in its entirety.

What is claimed is:

1. An image forming apparatus comprising:

an image forming unit configured to form a toner image on a recording material;

a fixing unit comprising a fixing member configured to fix the toner image to the recording material, and a pressure member configured to abut against the fixing member and form a first nip portion configured to nip and convey the recording material;

a first drive unit configured to rotate the fixing member;

a conveyance portion arranged downstream of the first nip portion in a conveyance direction of the recording material and configured to form a second nip portion configured to nip and convey the recording material, the second nip portion being arranged at a position where a distance from the first nip portion is shorter than a length of the recording material being conveyed;

a second drive unit configured to rotate the conveyance portion; and a control unit configured to execute a conveyance mode in which the recording material is conveyed in a conveyance period while the recording material is nipped at the first nip portion and the second nip portion, the conveyance period including a first period and a second period following the first period, wherein in a case where the control unit executes the conveyance mode, (i) in the first period, the control unit is configured to control at least one of the first drive unit and the second drive unit such that a peripheral speed of the conveyance portion is faster than a peripheral speed of the fixing member, and (ii) in the second period, the control unit is configured to control at least one of the first drive unit and the second drive unit such that the peripheral speed of the conveyance portion is slower than the peripheral speed of the fixing member.

2. The image forming apparatus according to claim 1, wherein a line connecting an upstream end of the second nip portion and a downstream end of the first nip portion is positioned more toward the fixing member than a line connecting an upstream end and a downstream end of the first nip portion in the conveyance direction.

3. The image forming apparatus according to claim 1, wherein, in the conveyance mode, a peripheral speed of the conveyance portion is greater than a peripheral speed of the fixing member from after a leading edge of the recording material has reached the second nip portion until before a predetermined timing is reached.

4. The image forming apparatus according to claim 1, wherein, in the conveyance mode, a peripheral speed of the conveyance portion is greater than a peripheral speed of the fixing member from a predetermined timing after a trailing edge of the recording material has passed through the first nip portion and before the trailing edge of the recording material passes through the second nip portion until the trailing edge of the recording material passes through the second nip portion.

5. The image forming apparatus according to claim 1, wherein the image forming unit comprises:

a transfer member configured to form a transfer nip portion in which the toner image formed on the image forming unit is transferred to the recording material, and a conveyance detection unit provided downstream of the transfer nip portion and upstream of the first nip portion in the conveyance direction, the conveyance detection unit configured to detect passing of a trailing edge of the recording material through the transfer nip portion.

6. The image forming apparatus according to claim 1, wherein a distance between the first nip portion and the second nip portion in the conveyance direction is shorter than a length of a smallest size of the recording material that can be conveyed.

7. The image forming apparatus according to claim 1, wherein the second nip portion is disposed adjacent to the first nip portion in the conveying direction.

8. The image forming apparatus according to claim 1, further comprising an auxiliary rotary portion provided between the first nip portion and the second nip portion in the conveyance direction and configured to nip and convey the recording material.

9. The image forming apparatus according to claim 8, wherein a pressure of a nip portion formed by the auxiliary rotary portion is less than a pressure of the second nip portion.

10. The image forming apparatus according to claim 8, wherein the auxiliary rotary portion is driven by the first drive unit.

11. The image forming apparatus according to claim 1, further comprising an operation unit configured to select whether to execute the conveyance mode, wherein the control unit is configured to execute the conveyance mode in a case where execution of the conveyance mode is selected by the operation unit.

12. The image forming apparatus according to claim 1, further comprising a humidity detection unit configured to detect humidity, wherein, during an image forming job, the control unit is configured to automatically execute the conveyance mode based on a detection result of the humidity detection unit.

13. The image forming apparatus according to claim 1, wherein the control unit is configured to acquire information related to the recording material during an image forming job and automatically execute the conveyance mode based on the information related to the recording material.

14. The image forming apparatus according to claim 13, wherein the information related to the recording material is a grammage of the recording material, and wherein, during the image forming job, the control unit is configured to execute the conveyance mode in a state where the grammage of the recording material is greater than a predetermined value.

15. The image forming apparatus according to claim 1, wherein, during the image forming job, the control unit is configured to execute a different conveyance mode of conveying the recording material so that the recording material is not looped between the first nip portion and the second nip portion.

16. The image forming apparatus according to claim 15, further comprising an operation unit configured to enter an instruction of setting a mode to be executed by the control unit among a plurality of modes including the conveyance mode and the different conveyance mode.

17. The image forming apparatus according to claim 1, wherein the fixing member is a film, wherein the image forming apparatus further comprises a planar heater configured to heat the film, and wherein the planar heater is configured to press the pressure member via the film to form the first nip portion.

* * * * *